US008063362B1

(12) United States Patent
Dressler et al.

(10) Patent No.: US 8,063,362 B1
(45) Date of Patent: Nov. 22, 2011

(54) IONIC LIQUID MEMBRANE FOR AIR-TO-VACUUM SEALING AND ION TRANSPORT

(75) Inventors: Rainer A. Dressler, Arlington, MA (US); Yu-Hui Chiu, Waltham, MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 133 days.

(21) Appl. No.: 12/500,180

(22) Filed: Jul. 9, 2009

(51) Int. Cl.
*H01J 49/00* (2006.01)

(52) U.S. Cl. ..... 250/289; 250/288; 250/281

(58) Field of Classification Search ..... 250/288, 250/289, 281, 282, 283, 284, 285, 286, 287; 436/173
See application file for complete search history.

(56) References Cited

U.S. PATENT DOCUMENTS

| | | | | |
|---|---|---|---|---|
| 7,087,436 | B2 * | 8/2006 | Baumgardner et al. | 436/173 |
| 2007/0278401 | A1 * | 12/2007 | Finlay | 250/289 |
| 2011/0006198 | A1 * | 1/2011 | Whitehouse et al. | 250/282 |

* cited by examiner

*Primary Examiner* — Jack Berman
*Assistant Examiner* — Jason McCormack
(74) *Attorney, Agent, or Firm* — AFMCLO/JAZ; Fredric Sinder

(57) ABSTRACT

An ionic liquid membrane provides both vacuum sealing and ion transport for a mass spectrometer. Ion transport is necessary to take advantage of modern Electrospray Ionization (ESI) and Desorption Electrospray Ionization (DESI) methods. Combining vacuum sealing for the mass spectrometer with ion transport into the mass spectrometer reduces, and can eliminate, the need for multiple differential pumping stages significantly reducing size, weight and power requirements.

9 Claims, 5 Drawing Sheets

IONIC LIQUID MEMBRANE FOR AIR-TO-VACUUM SEALING AND ION TRANSPORT

RIGHTS OF THE GOVERNMENT

The invention described herein may be manufactured and used by or for the Government of the United States for all governmental purposes without the payment of any royalty.

BACKGROUND OF THE INVENTION

The invention relates generally to mass spectrometers, and more specifically to apparatus and methods utilizing ionic liquids for air-to-vacuum sealing of mass spectrometers and for ion transport of ambient ions into a mass spectrometer.

The use of mass spectrometers in the field for analyzing environmental samples at ambient pressures is limited by the lack of truly portable mass spectrometers. Portability, particularly for military use, means battery operation for a soldier already carrying close to one hundred pounds of equipment. The primary hurdle is the need for heavy vacuum pumps and multiple vacuum stages in a typical mass spectrometer.

The sensitivity and specificity of mass spectrometers for detecting trace species is unparalleled. In mass spectrometers, samples are ionized and their ion trajectories in an electric and/or a magnetic field measured to determine the mass-to-charge ratio of the ions. The observed mass spectra allow identification of the original samples.

The development of Electrospray Ionization (ESI) allowed highly non-volatile samples such as biomolecules to be analyzed by mass spectrometers, greatly extending their utility. The development of ESI for analysis of biological macromolecules was rewarded with a Noble Prize in Chemistry to John Bennett Fenn in 2002.

The use of mass spectrometry to study environmental samples in the field, however, is limited both by equipment size and weight and by sample preparation times.

The problem of sample preparation times has been reduced by the development of a highly sensitive mass spectrometric approach for probing surface adsorbates at ambient pressures without a need for sample preparation. The method, described in U.S. Pat. No. 7,335,897 to Takats et al. called Desorption Electrospray Ionization (DESI), exposes a surface of interest to an ESI source that produces ions and charged droplets that, when impinging on the surface, desorb surface material that ionize in the spray. The desorbed ions are then collected by the inlet system of a conventional mass spectrometer for analysis. DESI, as well as ESI, are known as soft-ionization approaches in which the resulting ions experience little fragmentation, thereby minimizing spectral congestion. DESI mass spectra resemble closely ESI mass spectra, where the sample is dissolved in a volatile solvent that is electrosprayed into a mass spectrometer.

That still leaves the problem of the size and weight of mass spectrometers as a limiting factor for their use to study environmental samples in the field.

By whatever means an ambient sample is ionized, it must then be introduced into the inlet of the first vacuum stage of a traditional mass spectrometer. Because the inlet is exposed to the atmosphere, maintaining a sufficient vacuum throughout the process path of a typical mass spectrometer requires as many as five differently sized pumps to maintain a vacuum.

The process path of a typical mass spectrometer may include three differentially pumped chambers, a first pumping stage usually involving a powerful mechanical pump and two high vacuum stages, the first for ion transport and possibly cooling, and the second housing the mass analyzer and detector. The second stage may be omitted if the mass analyzer does not require highly thermalized ions.

The vacuum system is the largest, heaviest and most power-consuming component of a mass spectrometer and represents the main impediment to making a portable ambient mass spectrometer.

If the flow of atmospheric gases into a mass spectrometer could be eliminated, only a turbopump and a low power roughing pump, such as a diaphragm pump, at most, would be needed. These two pumps could even be smaller than those in a differentially pumped system due to the negligible load, outgassing from internal components being the main source of gasses. A well outgassed system, that is, a system connected to a vacuum pump sufficiently long for outgassing to complete, could be operated without pumps for a significant length of time.

It is, therefore, an object of the invention to provide an atmospheric seal for the inlet of a mass spectrometer.

Achieving that object, however, still leaves a problem of transporting ions from the DESI technique into the mass analyzer section of a mass spectrometer.

It is, therefore, another object of the invention to provide an atmospheric seal for the inlet of a mass spectrometer that permits passage of sample ions through the seal into the mass spectrometer.

In a separate area of research, ionic liquids, or room temperature molten salts, are liquids consisting entirely of ions and have unique properties making them attractive for a large number of industrial applications. Among those attractive properties are their negligible vapor pressures and their versatility as solvents for both inorganic and organic materials. Those properties enable electrospraying ionic liquids in a vacuum, contrary to the types solutions used in a typical ESI experiment. In a vacuum, the volatility of conventional ESI solvent solutions, where volatile solvents are used to carry solutes, would compromise both the vacuum as well as causing freezing of the solution, thereby discontinuing the flow of the spray.

A team of researchers, including one of the inventors of this invention, recently discovered that certain ionic liquids can be electrosprayed in a pure ion emission mode, that is, the spray does not include charged droplets, but only ions. The discovery is described in "Mass Spectrometric Analysis of Colloid Thruster Ion Emission from Selected Propellants," Y. Chiu, B. L. Austin, R. A. Dressler, D. Levandier, P. T. Murray, P. Lozana and M. Martinez-Sanchez, *J. Prop. Power,* 2005, 21, 416-423, which is incorporated by reference into this application.

In an additional development, two other members of that team have discovered that ionic liquids can be sprayed into a vacuum from wetted sharp needle tips. This external wetting approach, coupled with small and sharp needles, forces many ionic liquids to emit in a pure ion emission mode. Further, extraction voltages can be as low as 1 kV, significantly enhancing the miniaturization potential of an ESI source. This discovery is described in "Ionic Liquid Ion Sources: Characterization of Externally Wetted Emitters," P. Lozano and M. Martinez-Sanchez, *J. Coll. And Interface Sci.,* 2005, 282, 415-421, which is incorporated by reference into this application.

SUMMARY OF THE INVENTION

The invention provides a new apparatus and method for air-to-vacuum sealing and ion transport that makes possible, in an example embodiment, a portable mass spectrometer for analyzing environmental samples in the field at ambient pressures. It does this primarily by reducing the need for heavy vacuum pumps and multiple vacuum stages in a mass spectrometer.

The invention eliminates the differential pumping stages and directly connects the inlet to the mass analyzer by replacing prior art inlet systems with an ionic liquid membrane.

The invention further takes advantage of new discoveries involving ionic liquids so that ion transport through the ionic liquid membrane can Occur.

The unique discovery of the invention is that an ionic fluid membrane can provide both air-to-vacuum sealing at the inlet to a mass spectrometer and ion transport of sample ions from the atmosphere into the mass spectrometer.

The invention is directed to a mass spectrometer, comprising an ionization region for ionizing a sample under atmospheric pressure; an aperture for transporting ions generated in the ionization region into a vacuum; and, an ionic liquid membrane covering the aperture. The mass spectrometer may further comprise a conductive needle through the ionic liquid membrane and an extraction electrode for attracting ions from the conductive needle into the vacuum.

The invention is also directed to a method for analyzing ionized samples using a mass spectrometer having an aperture from the atmosphere into a vacuum, comprising flowing the ionized samples through an ionic liquid membrane covering the aperture into the vacuum. The method may further comprise extracting ionized samples from a conductive needle inserted through the ionic liquid membrane into the vacuum and applying an alternating electric field for extracting ionized samples from the conductive needle into the vacuum.

The invention is also directed to a vacuum seal for transporting ions from a higher pressure region to a lower pressure region comprising an aperture covered by an ionic liquid membrane. The vacuum seal may further comprise a conductive needle inserted through the ionic liquid membrane into the lower pressure region and an alternating polarity electric field for extracting ions from the conductive needle into the lower pressure region.

DETAILED DESCRIPTION

Figure 1:
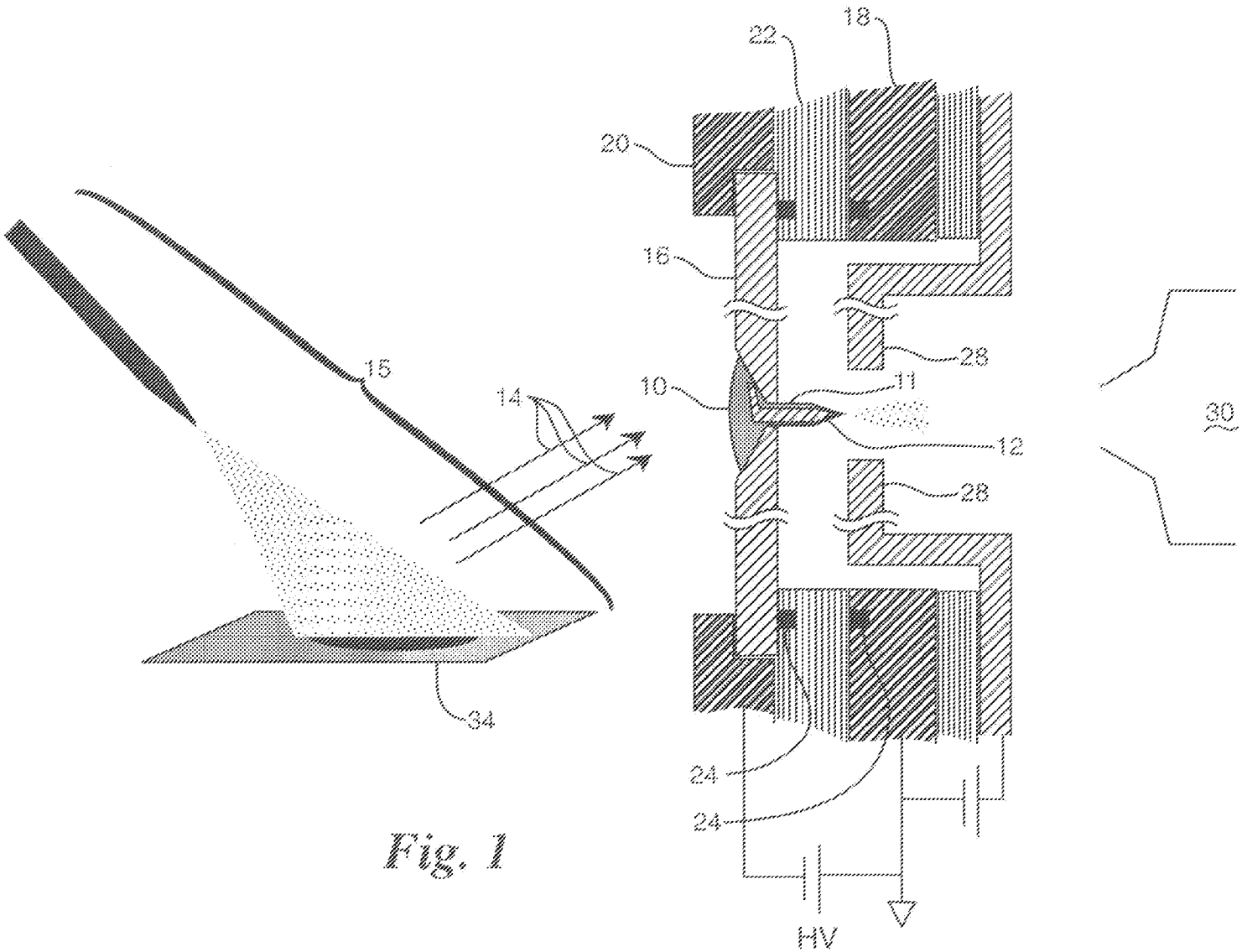
FIG. 1 is a cross-sectional view of an example embodiment of the invention showing the use of an ionic liquid membrane and an emitter needle for both air-to-vacuum sealing and ion transport of sample ions to be analyzed.

FIG. 1 is a cross-sectional view of an example embodiment of the invention showing the use of an ionic liquid membrane 10 and an emitter needle 12 for both air-to-vacuum sealing and ion transport of sample ions 14 to be analyzed. FIG. 1 shows the invention used in conjunction with an atmospheric DESI experiment as described in the Background of the Invention. Ionic liquid membrane 10 is situated on the aperture 11 of an electrically isolated membrane flange 16 mounted on a main mass spectrometer entrance flange 18 using a retainer 20 mounted to flange 18 using insulated screws (not shown) and an insulator gasket 22 made of ceramic or non-conducting polymer. Membrane flange 16, main flange 18, and insulator gasket 22 must form a vacuum seal, for example through the use of thin O-rings 24. The membrane flange must be made of a material that wets membrane 10, such as tungsten etched according to the procedure discussed by Lozano and Martinez-Sanchez in their 2004 *Journal of Colloid and Interface Science* article. Emitter needle 12 is inserted into aperture 11. Needle 12 must be etched to a very high sharpness, as described for tungsten by Lozano and Martinez-Sanchez. The sharpness and diameter of needle 12 governs the flow speed of the ionic liquid across the metal surface which in turn affects the droplet size and ion-to-droplet ratio.

The smaller the needle dimensions, the lower the flow rate, and the higher the ion-to-droplet ratio. At low enough flow rates, droplet emission is entirely eliminated. In our laboratory, an ionic liquid [Emim][$BF_4$] has been operated free of droplets using a 500 micron needle etched to a tip curvature of 10 microns. The diameter and depth of an aperture, as well as the needle diameter, must be chosen so that a drop of ionic liquid can seal the vacuum while remaining immobilized. The atmospheric end of emitter needle 12 is bent to prevent the needle from sliding into the vacuum. The bent end of the emitter can be spot-welded to flange 18 if centering of needle 12 is critical. On the vacuum side, emitter needle 12 faces an extraction electrode 28. Voltages applied to membrane flange 16 and extraction electrode 28 drive the ESI process as well as ion transport through membrane 10. The emitted ions then enter a mass analyzer 30. An atmospheric ESI source 32 sprays a sample 34 in close vicinity to membrane 10. Desorbed ions 14 are then attracted to membrane 10 through the voltage applied to membrane flange 16.

A critical part of the assembly is insertion of needle 12. Depending on the viscosity of the ionic liquid, the difference between the inner diameter of aperture 11 and the outer diameter of needle 12 could be quite small, and insertion must occur in a way both to avoid blunting the tip and to optimally center the needle.

Figure 2:
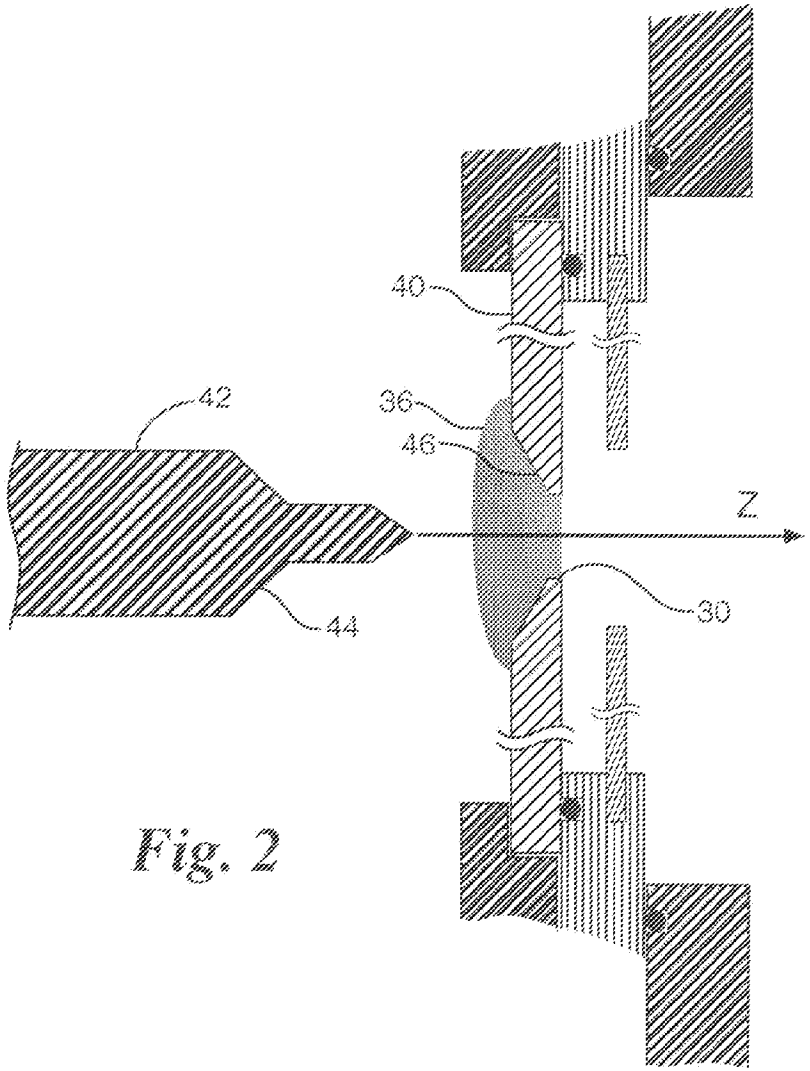
FIG. 2 is a cross-sectional view of another example embodiment of the invention showing the use of an ionic liquid membrane and an emitter needle at the aperture opening of a mass spectrometer.
Figure 3:
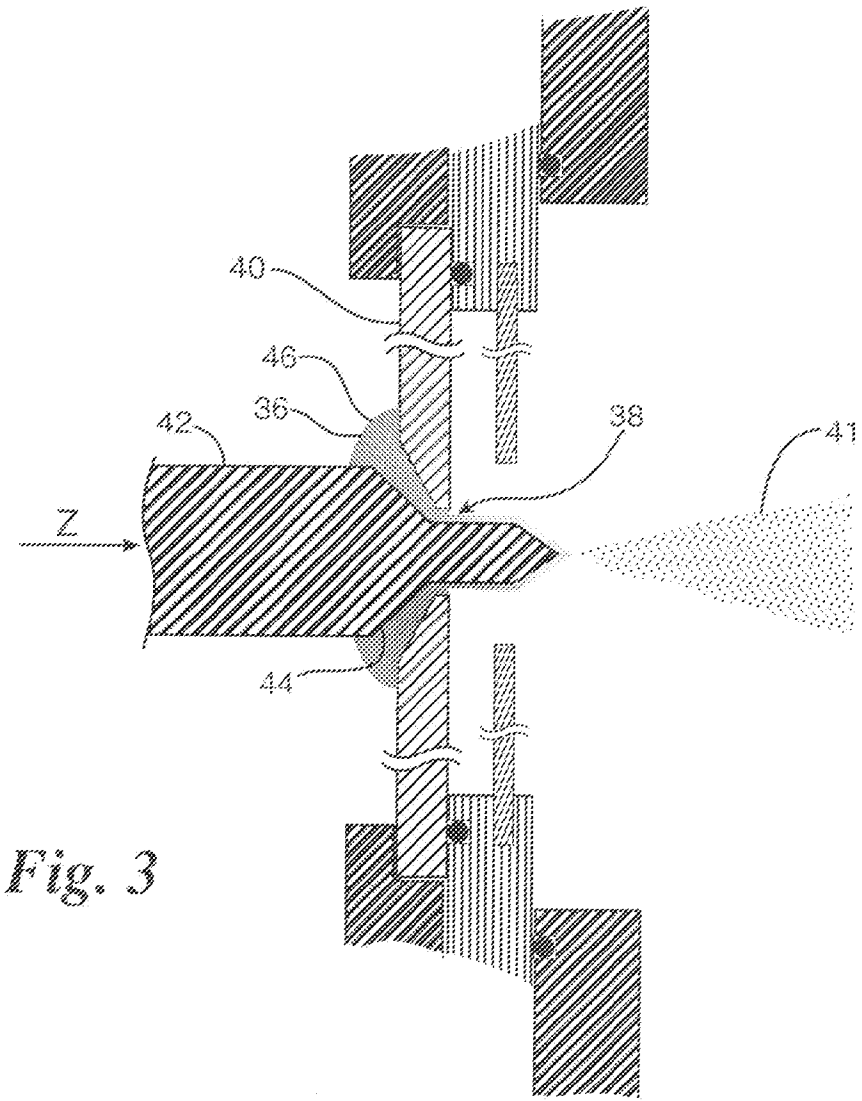
FIG. 3 is a cross-sectional view of the example embodiment of FIG. 2*a* showing the emitter needle inserted into the aperture.

FIGS. 2 and 3 show an alternative design of the membrane with an assembly procedure. In FIGS. 2 and 3, an ionic liquid droplet 36 is placed on an aperture 38 of a membrane flange 40 while the vacuum side of flange 40 is at atmospheric pressure. An emitter needle 42 is mounted on a precision XYZ positioner (not shown). A video microscope (also not shown) is used to view aperture 38 as needle 42 is centered and positioned in aperture 38. Needle 42 has a micro-machined conical seat 44 to match a conical edge 46 of aperture 38. Needle 42 is moved into the +z direction until a snug fit is obtained. The mass spectrometer is then evacuated. Once vacuum is obtained, needle 42 is translated in the −z direction as far as it can be moved without causing movement of the ionic liquid towards the needle tip and the vacuum. The amount of safe translation can be determined by experiment. Needle 42 must then be anchored by, for example, attaching the atmosphere side end to a precision fixture to which the needle potential is applied, or by spot-welding it to membrane flange 40. Membrane 36 is now ready for electrical connections. Successful operation of membrane 36 will require proper voltage biasing of the needle and extractor to attract atmospheric ions to the membrane from the sample, and to spray transported ions 41 in the vacuum. Simultaneously, the ionic liquid ESI vacuum source must be kept stable by operating it in an alternating polarity mode as taught by Lozano and Martinez-Sanchez. The DESI experiment exhibits sensitivity in both a positive ion and negative ion mode.

Figures 4A, 4B:
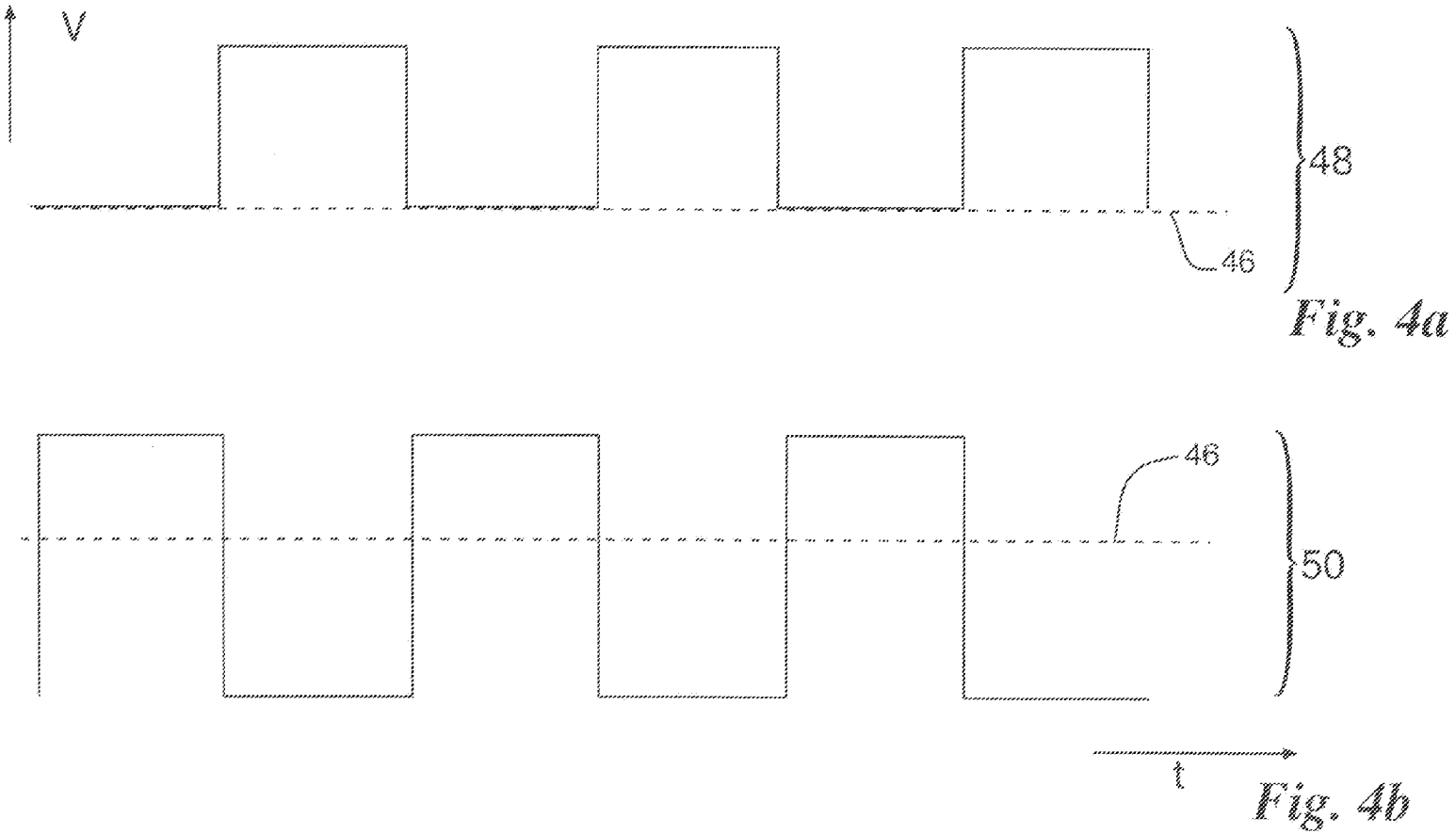
FIG. 4 is a graphic representation of alternating voltage polarities applied to the atmospheric ESI source and ionic membrane ESI vacuum source.

FIG. 4 shows how positive ion sensing would be accomplished. Dashed line 46 represents ground. The atmospheric ESI source 48 would be turned on (high positive voltage) intermittently with an approximate frequency of 1 Hz. While source 48 is on, a membrane/vacuum ESI source 50 is held at a negative potential. This negative potential has three functions: (1) attract DESI ions towards the membrane; (2) reverse the polarity to interrupt electro-chemical reactions; and, (3) control the transport of dissolved sample ions through negative charge emission in vacuum. The amplitude and dwell time of the negative cycle can be optimized to minimize transport times. When atmospheric ESI source 48 is off, membrane/vacuum ESI 50 turns to positive charge emission and transport of ions through the membrane.

Figure 5:
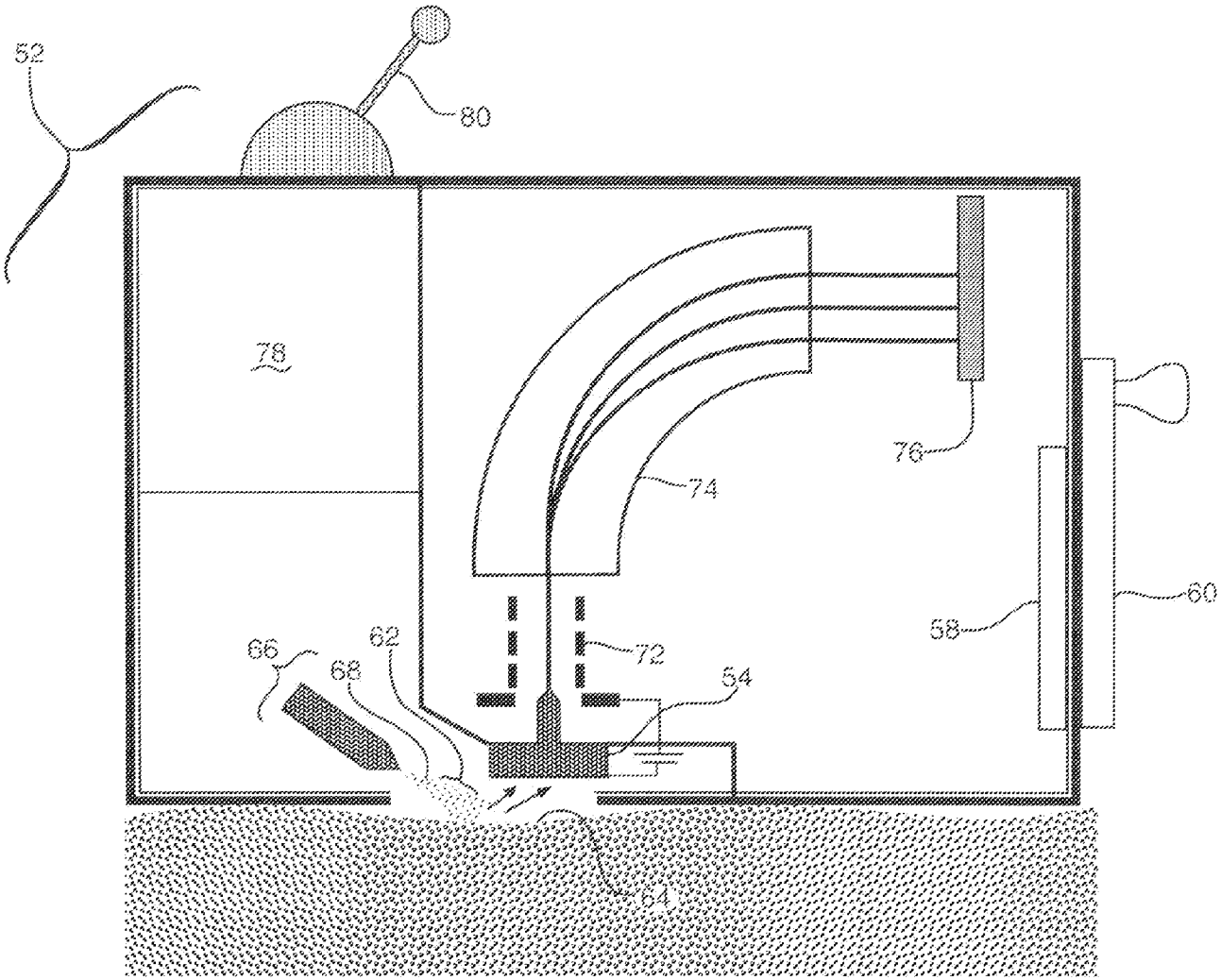
FIG. 5 is a cross-sectional view of an example embodiment of the invention for use in a remote environment.

FIG. 5 shows a concept of a miniaturized, remotely deployable mass spectrometric instrument 52 using an ionic liquid membrane 54 in conjunction with a DESI source. Mass spectrometer 52 will be evacuated at a central pumping station through a vacuum port 58 equipped with a gate valve 60. Once sealed by gate valve 60, mass spectrometer 52 is deployed such that the sensing aperture 62 faces a surface 64 of interest, for example as a drop unit with parachute and an appropriate mechanical design to minimize the chance of tumbling, or through the use of a rover vehicle design. A miniaturized ESI source 66 generates DESI ions 68 from surface adsorbed species. Ions 68 are electrostatically attracted to ionic liquid membrane 54 through which the ions are transported to the vacuum side of mass spectrometer 52, where they are electro sprayed with an extraction lens 72 into a mass spectrometer chamber 74 suited for energetic ions (~1 keV). A small magnetic sector with position sensitive detection (for example a linear ion imaging detector 76) is likely the best option at this stage. Mass spectrometer 52 is designed to maintain sufficient vacuum for several hours allowing necessary sensing to be accomplished. It can be controlled by an integrated power unit 78 and monitored through radio 80. Any ionic liquid can be used for the membrane as long as it can be operated in an emission mode with high ion-to-droplet fraction, the mass spectrum of the ions is sparse, and the mass spectrometer is not affected by charged droplets. If the latter is not the case (for example when using a quadrupole mass spectrometer where droplets create backgrounds), ionic liquids must be chosen that can readily produce pure ion currents with sharp needles.

The ionic liquid membrane performs four primary functions as part of the example disclosed embodiment:

(a) Seals the inlet aperture of a mass spectrometer under vacuum. This function exploits the liquid viscosity and negligible vapor pressure properties of ionic liquids.

(b) Captures and dissolves sample ions produced in a DESI experiment on the atmosphere side of the membrane. This function exploits the ionic nature and solvent properties of an ionic liquid.

(c) Transports sample ions to the vacuum side of the membrane. This function is provided by the ESI extraction voltage.

(d) Provide an ESI medium for a mass spectrometer ion source.

The disclosed new use of an ionic liquid membrane for both vacuum sealing and ion transport for a mass spectrometer using the DESI technique successfully demonstrates the use and value of some of the properties of ionic liquids. Although the disclosed embodiments are specialized, their teachings will find application in other areas where these, and other, properties of ionic liquids can be utilized to improve apparatus and methods in other art areas.

Terms used in the claims are used with their ordinary meanings as understood by those with skill in their application art areas. A "vacuum," for example, does not require the complete absence of any molecules, but only to the extent usually found in the art. Similarly, a "vacuum seal" is a convenient term for any seal that reduces passage of molecules from regions of different pressures, without necessarily limited to one region having a "vacuum." The term "atmospheric seal" is likely more accurate as applied to the example embodiment of the invention involving a mass spectrometer described in this Detailed Description, but is less able to be understood as applying more generally to regions of different pressures.

Various modifications to the invention as described may be made, as might occur to one with skill in the art of the invention, within the scope of the claims. Therefore, all contemplated embodiments have not been shown in complete detail. Other embodiments may be developed without departing from the spirit of the invention or from the scope of the claims.

We claim:

1. A mass spectrometer, comprising:

(a) an ionization region for ionizing a sample under atmospheric pressure;

(b) an aperture for transporting ions generated in the ionization region into a vacuum; and, (c) an ionic liquid membrane covering the aperture.

2. The mass spectrometer of claim 1, further comprising a conductive needle through the ionic liquid membrane.

3. The mass spectrometer of claim 2, further comprising an extraction electrode for attracting ions from the conductive needle into the vacuum.

4. A method for analyzing ionized samples using a mass spectrometer having an aperture from the atmosphere into a vacuum, comprising flowing the ionized samples through an ionic liquid membrane covering the aperture into the vacuum.

5. The method for analyzing ionized samples according to claim 4, further comprising extracting ionized samples from a conductive needle inserted through the ionic liquid membrane into the vacuum.

6. The method for analyzing ionized samples according to claim 5, further comprising applying an alternating electric field for extracting ionized samples from the conductive needle into the vacuum.

7. A vacuum seal for transporting ions from a higher pressure region to a lower pressure region comprising an aperture covered by an ionic liquid membrane.

8. The vacuum seal according to claim 7, further comprising a conductive needle inserted through the ionic liquid membrane into the lower pressure region.

9. The vacuum seal according to claim 8, further comprising an alternating polarity electric field for extracting ions from the conductive needle into the lower pressure region.

* * * * *